US005186451A

United States Patent [19]

Hirao

[11] Patent Number: 5,186,451

[45] Date of Patent: Feb. 16, 1993

[54] SHEET PAPER FEED APPARATUS HAVING VACUUM FEED ROLLERS

[75] Inventor: Naoto Hirao, Kawasaki, Japan

[73] Assignee: Fujitsu Limited, Kawasaki, Japan

[21] Appl. No.: 637,772

[22] Filed: Jan. 7, 1991

[30] Foreign Application Priority Data

Jan. 18, 1990 [JP] Japan ..... 2-10397
Jan. 18, 1990 [JP] Japan ..... 2-10398

[51] Int. Cl.[5] ..... G03G 15/00

[52] U.S. Cl. ..... 271/196; 271/276; 355/312

[58] Field of Search ..... 355/312; 271/96, 108, 271/194, 196, 197, 276, 90; 226/7, 95

[56] References Cited

U.S. PATENT DOCUMENTS 4,145,040 3/1979 Huber ..... 271/196 X
4,207,998 6/1980 Schmid ..... 271/196 X
4,214,831 7/1980 Reesen ..... 355/312
5,031,002 7/1991 Yaguchi ..... 355/312

FOREIGN PATENT DOCUMENTS 205175 11/1983 Japan ..... 355/312

*Primary Examiner*—Joan H. Pendegrass
*Assistant Examiner*—J. E. Barlow, Jr.
*Attorney, Agent, or Firm*—Staas & Halsey

[57] ABSTRACT

A sheet paper feed apparatus has a hollow center shaft, a roller which has peripheral holes and rotates around the center shaft, and a negative pressure source communicating with the center shaft. Rotation of the roller causes the peripheral holes to successively create a suction action to adhere and feed the sheet paper. The center shaft has an opening at a position shifted by a predetermined angle in the direction of sheet feed with respect to a surface that is vertical with respect to the sheet paper feed surface and passes through a center of the center shaft.

9 Claims, 13 Drawing Sheets

SHEET PAPER FEED APPARATUS HAVING VACUUM FEED ROLLERS

BACKGROUND OF THE INVENTION

The present invention relates to a feed apparatus, and more particularly, to a sheet paper feed apparatus suited to an image forming apparatus.

FIG. 1 generally shows an image forming apparatus 10 as one example of an apparatus in which a sheet paper feed apparatus of a general type has been incorporated.

Around the periphery of a photosensitive drum 11, are disposed a cleaner 12, a pre-charger 13, an exposer 14, a developer 15, a transfer unit 16 and the like.

The photosensitive drum 11 rotates in the direction indicated by the arrow A and first forms a latent image, and then a toner image.

Numeral 17 represents a flush light fixing apparatus.

Numeral 18 and 19 represent sheet paper feed apparatus.

The sheet paper 20 is supplied from a paper supply portion (not indicated in the figure), is fed in the direction of the arrow B by the feed apparatus 19 and then is conveyed in the direction of the arrow C by the feed apparatus 18, and discharged to the stacker portion (not indicated in the figure).

The transfer unit 16 transfers the toner image on the photosensitive drum 11 to the sheet paper 20 and the toner image on the sheet paper 20 is fixed to the sheet paper 20 by the flush light fixing apparatus 17.

In recent years, the operation of the image forming apparatus 10 has increased and accompanying this has been an increase in the feed speed of sheet paper.

When sheet paper is fed at high speed, it is that much easier for the status of the sheet paper that is being fed, to become unstable, and thus for paper misfeed to occur.

Because of this, it is necessary to improve the feed apparatus 18, 19 so that they have a higher reliability.

FIG. 2 shows conventional sheet feed apparatus 31, 32 and 33 corresponding to the sheet paper feed apparatus represented by the numeral 18 in FIG. 1.

The sheet feed apparatus 31, 32 and 33 are lined up in direction C for feeding the sheet paper.

Each of the sheet feed apparatus 31, 32 and 33 has a structure where hollow fixed center shafts 31-1, 32-1 and 33-1 carry rollers 31-2, 32-2 and 33-2, respectively, so that they are rotatable.

Each of the rollers 31-2, 32-2 and 33-2 has formed along its entire periphery a plurality of holes 31-2*a*, 32-2*a* and 33-2*a*.

In addition, each of the hollow fixed center shafts 31-1, 32-1 and 33-1 has respectively formed in it openings 31-1*a*, 32-1*a* and 33-1*a*.

Each of the hollow fixed center shafts 31-1, 32-1 and 33-1 communicates with a negative pressure source 34.

The rollers 31-2, 32-2 and 33-2 are rotated in the counterclockwise direction as indicated by the arrow D, and of the plurality number of holes 31-2*a*, 32-2*a* and 33-2*a*, the holes that successively oppose openings 31-1*a*, 32-1*a* and 33-1*a* produce a suction action that causes the sheet paper to adhere to them while the rotational force of the rollers 32-2 through 33-2 applies a feed force in the direction of the arrow C.

The sheet paper 20 is adhered by the portions of each of the apparatus 31, 32 and 33 and is thereby fed.

Here, the openings 31-1*a*, 32-1*a* and 33-1*a* are formed at portions that are inclined by the angle $\alpha = 10°$) in the direction opposite the sheet paper feed direction (clockwise, in FIG. 2) with respect to the surfaces 35, 36 and 37 that are vertical with respect to the sheet paper feed surface 22 which passes through the centers of the apparatus 31, 32 and 33. This structure is adopted so as to adhere, as soon as possible, the sheet paper that has been fed and arrived.

As is shown in the enlarged view of FIG. 3, each of the plurality of holes 33-2*a* perform suction action while it moves from a position on the forward side with respect to the topmost point of the apparatus 33 to the topmost portion. The sheet paper 1 is thereby applied a feed force F1, as indicated by the arrow, in a direction inclining upwards by the angle $\alpha$ with respect to the sheet feed surface 22.

Because of this, as shown in FIG. 2, the sheet paper 20 rises up from the sheet feed surface 22 and the distal end of the sheet paper 20 catches on the step portion 24 of the lower surface of the flush light fixing apparatus 17 and causes paper misfeed.

FIG. 4 shows a conventional sheet paper feed apparatus 41, corresponding to the sheet paper feed apparatus represented by the number 19 in FIG. 1.

The sheet paper feed apparatus 41 is provided with a negative pressure source 44 passing through a hollow member 42 which is provided with a rotatable roller 43, and is disposed so as to be opposite and in the vicinity of the photosensitive drum 11.

Along the entire periphery of the roller 43 are formed a plurality of holes 46.

The hollow member 42 is formed with a single opening 47 that opposes the sheet paper peeling position 48 on the peripheral surface of the photosensitive drum 11.

The roller 43 rotates in the direction indicated by the arrow D, and the holes 46 come to successively oppose the opening 47 so that the holes 46 opposing the opening 47 produce a suction action. Accordingly, the sheet paper 20 is adhered to the roller 43 and is peeled from the photosensitive drum 11, at the same time as it is being conveyed in the direction of the arrow B by the rotation of the roller 43.

The holes 46 and the openings 47 have their relationship determined by the length "a" of the wall portion 50 between adjacent holes 46 and by the diameter "b" of the opening 47, where $a > b$.

Because of this, between the time when one of the holes 46 has passed the portion of the opening 47, and the next hole 46 is about to oppose the opening 47, the wall portion 50 completely covers the opening 47. At times such as this, the apparatus 41 does not generate a suction peeling force and resulting in no feed force.

For example, when the portion of the holes 46-1 through 46-3 rotates over the position of the opening 47, the holes 46-1 through 46-3 apply a suction force as indicated by the lines 51, 52 and 53 in FIG. 5 (A) through (C), and the suction force is intermittently applied in the sectional portion as indicated by the line 54 in FIG. 5 (D).

In addition, each of the holes 46-1 through 46-3 applies a feed force as shown by the lines 55, 56 and 57 in FIG. 6 (A) through (C), and the application of the feed force is intermittently in phase as shown by line 58 in FIG. 6 (D).

Because of this intermittent action when the photosensitive drum 11 in particular, is rotating at high speed and feeding the sheet paper 20 at high speed, there is the likelihood that the feeding of the sheet paper 20 will become unstable.

SUMMARY OF THE INVENTION

Accordingly, it is a general object of the present invention to provide a novel and useful sheet paper feed apparatus in which the problem described above has been eliminated.

Another and more specific object of the present invention is to provide a sheet paper feed apparatus wherein an opening of a hollow fixed center shaft is provided so as to be shifted in the direction of sheet paper feed with respect to a surface which is vertical to a sheet paper feed surface and extends through a center of the hollow fixed center shaft.

According to the present invention, the sheet paper feed force is applied in the direction inclined downwards with respect to the sheet paper feed surface. Because of this, it is possible to prevent the forward distal end in the direction of feed of the sheet paper from rising, and therefore stably feed the sheet paper.

Another object of the present invention is to provide a sheet paper feed apparatus wherein at least one of the plurality of holes in the roller always opposes an opening of a hollow fixed center shaft while a roller is rotating.

According to the present invention, it is possible for the feed force to act continuously with respect to the sheet paper so that it is possible to stably feed the sheet paper.

Other objects and further features of the present invention will be apparent from the following detailed description when read in conjunction with the accompanying drawings.

DESCRIPTION OF THE PREFERRED EMBODIMENTS

The description will commence with a description of one schematic configuration and the action of a sheet paper feed apparatus of the present invention.

Figure 1:
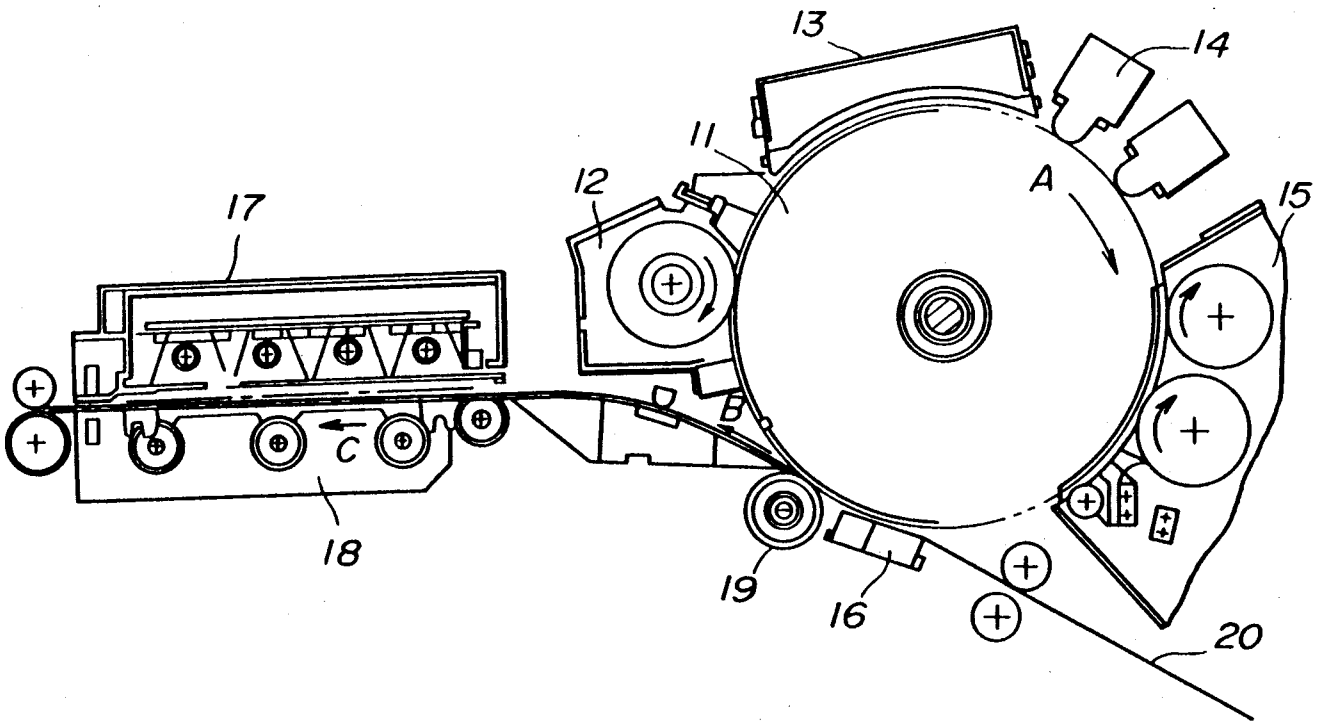
FIG. 1 is a view of an image forming apparatus which is one example of an apparatus to which a general sheet paper feed apparatus has been incorporated.
Figure 2:
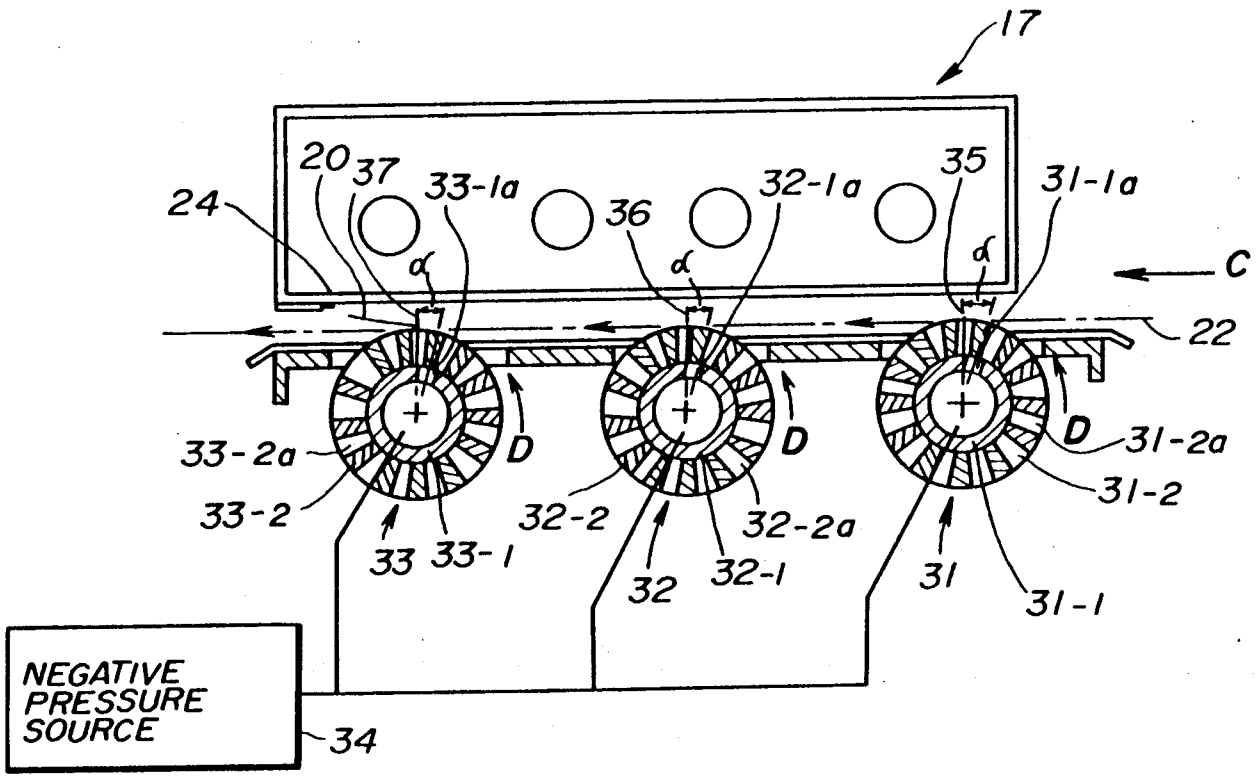
FIG. 2 PRIOR ART
FIG. 2 is a view showing one example of a conventional sheet paper feed apparatus.
Figure 3:
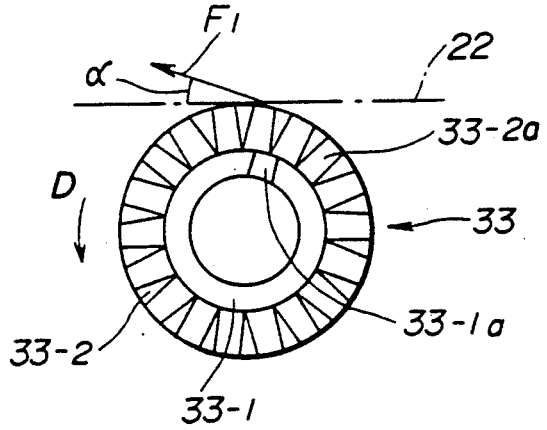
FIG. 3 PRIOR ART
FIG. 3 is a view showing the sheet paper feed by the apparatus in FIG. 2.
Figure 4:
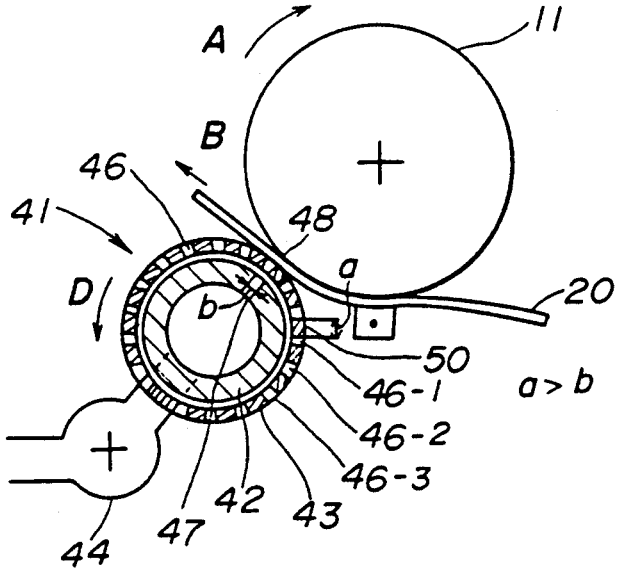
FIG. 4 PRIOR ART
FIG. 4 is a view showing another example of a conventional sheet paper feed apparatus.
Figure 5:
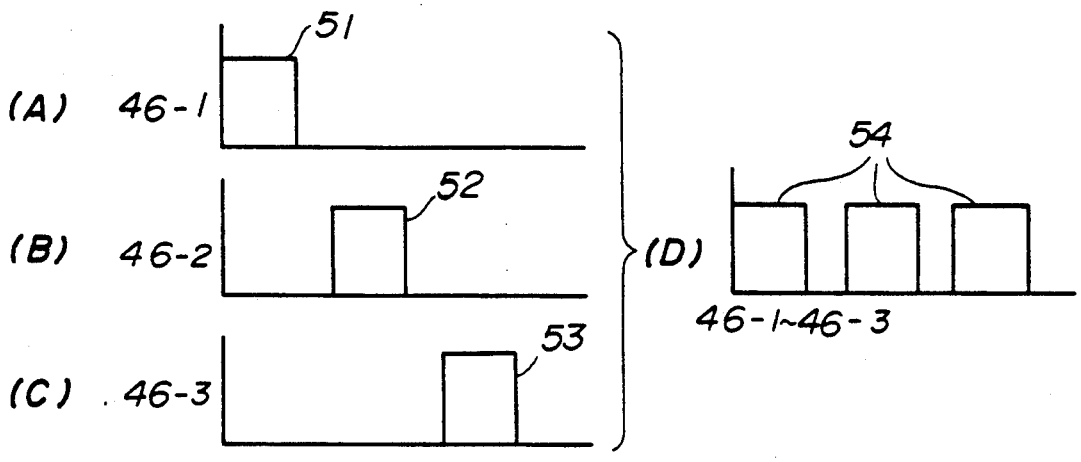
FIG. 5 PRIOR ART
FIG. 5 is a chart showing the operation for the action of the sheet paper suction force by the apparatus of FIG. 4.
Figure 6:
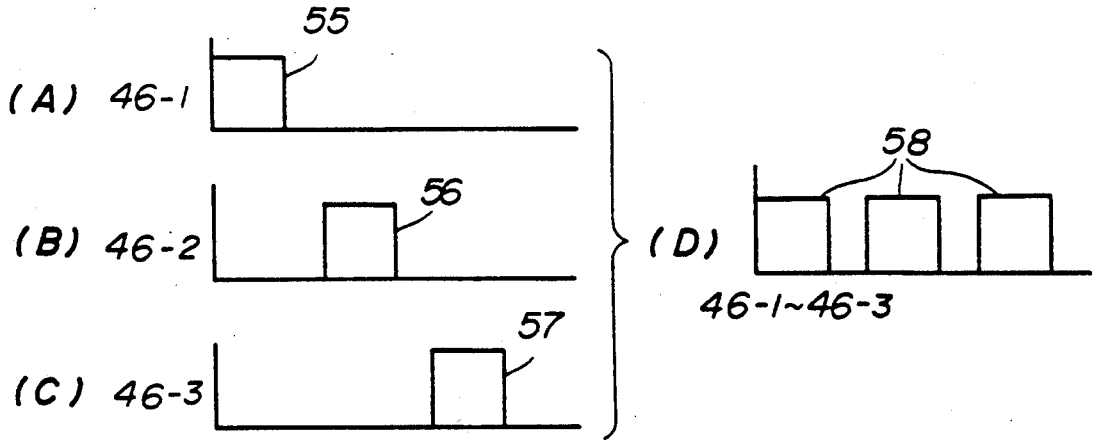
FIG. 6 PRIOR ART
FIG. 6 is a view for describing the operation for the action of the sheet paper feed force by the apparatus of FIG. 4.
Figure 7:
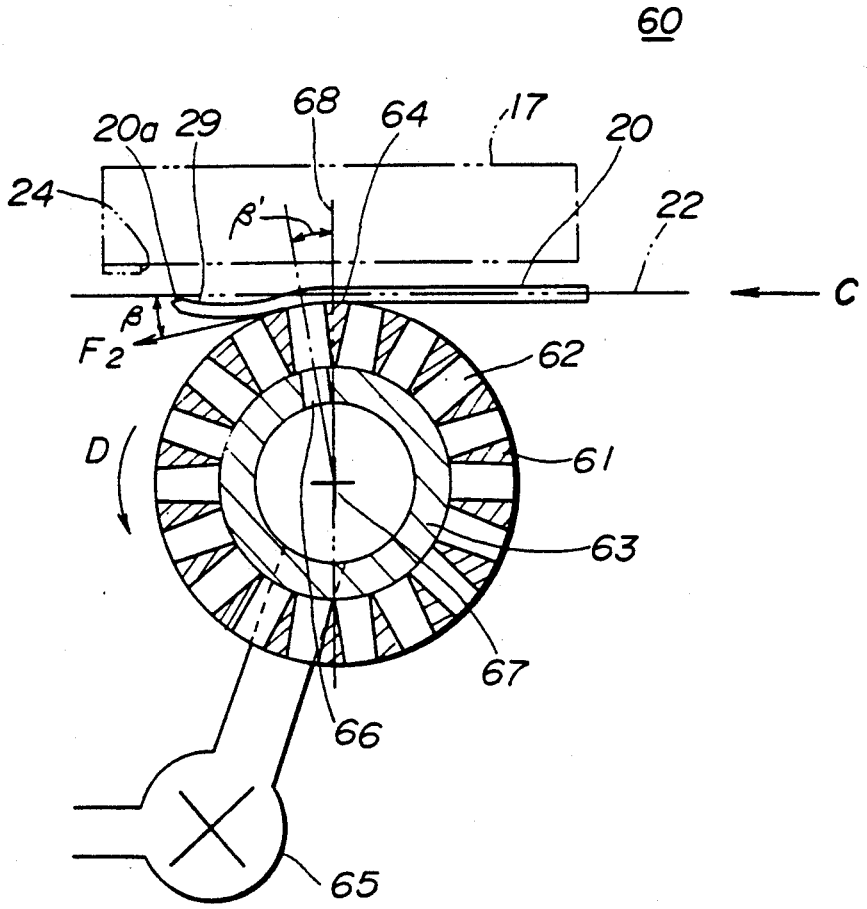
FIG. 7 is a view of a schematic configuration of the principle of the sheet paper feed apparatus of the present invention.

FIG. 7 shows a schematic configuration of a sheet paper feed apparatus 60 according to the present invention.

A roller 61 has a plurality of holes 62 around its entire periphery, is provided so as to be rotatable around a hollow fixed center shaft 63, and rotates in the direction shown by the arrow D so that a portion 64 in contact with a sheet paper 20 moves in the direction of sheet paper feed as shown by the arrow C.

A negative pressure source 65 is provided so as to communicate with the hollow fixed center shaft 63.

An opening 66 is formed so as to make a predetermined angle B in the direction of sheet paper feed C (the direction D of rotation of the roller 61), with respect to the surface 68 which is perpendicular to sheet paper feed surface 22 and extends through the center of the hollow fixed center shaft 63.

Each of the holes 62 adheres the sheet paper 20 via the opening 66 and the hollow fixed center shaft 63 due to the negative pressure source 65, inside the region that rotates with respect to the opening 66, and simultaneously, the rotation of the roller 61 applies a feed force shown by the arrow F2.

Here, the opening 66 forms an angle B' in the direction of sheet paper feed, with respect to the surface 68 and so the feed force to the sheet paper 20 is applied in a direction that is inclined at the angle $\beta$ in the direction inclining downwards with respect to the sheet feed surface 22.

Figure 8:
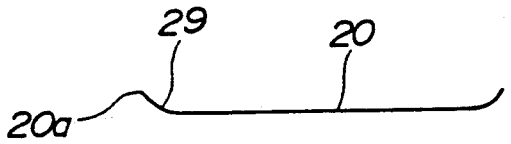
FIG. 8 is a view of one example of curled sheet paper.

Because of this, even in the case where the distal end 20*a* in the direction of feed of the sheet paper 20 is curled in the upwards direction as shown by the numeral 29 in FIG. 8, when the sheet paper 20 is fed by the roller 61, the height on the side of the distal end 20*a* is held in the downwards direction from the sheet paper feed surface 22 so that it does not rise upwards from the sheet paper feed surface 22.

Accordingly, the distal end 20*a* of the sheet paper 20 does not catch on the step portion 24 of the lower surface of the flush light fixing apparatus 17, and no paper jams occur.

The following is a description of a sheet paper feed apparatus 80 of one embodiment according to the present invention on the basis of the principle shown in FIG. 7. The description is made with reference to FIGS. 9 and 9A and FIG. 10.

Figures 9, 9A:
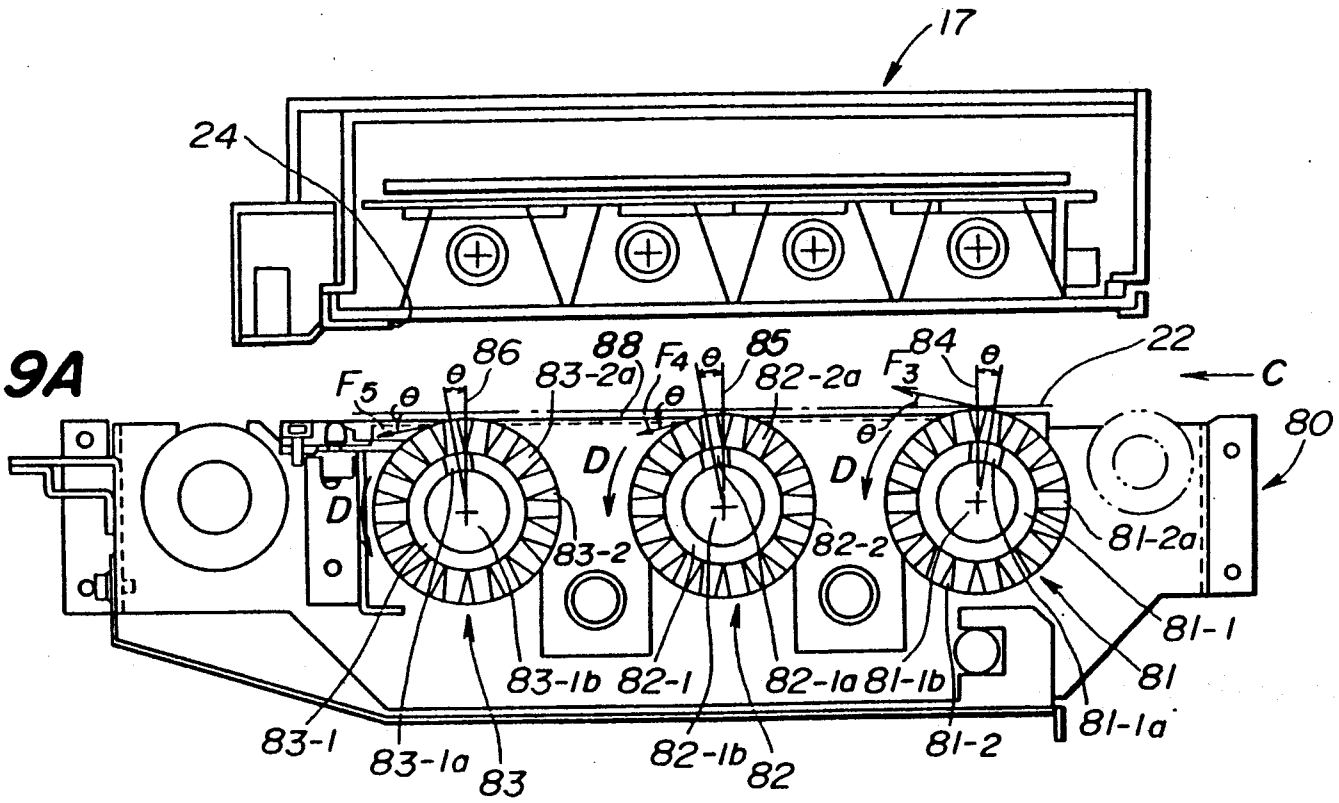
FIGS. 9 and 9A are a sectional view taken along the section lines IX—IX of FIG. 10, showing the sheet paper feed apparatus of first embodiment according to the present invention on the basis of the principle shown in FIG. 7.
Figure 10:
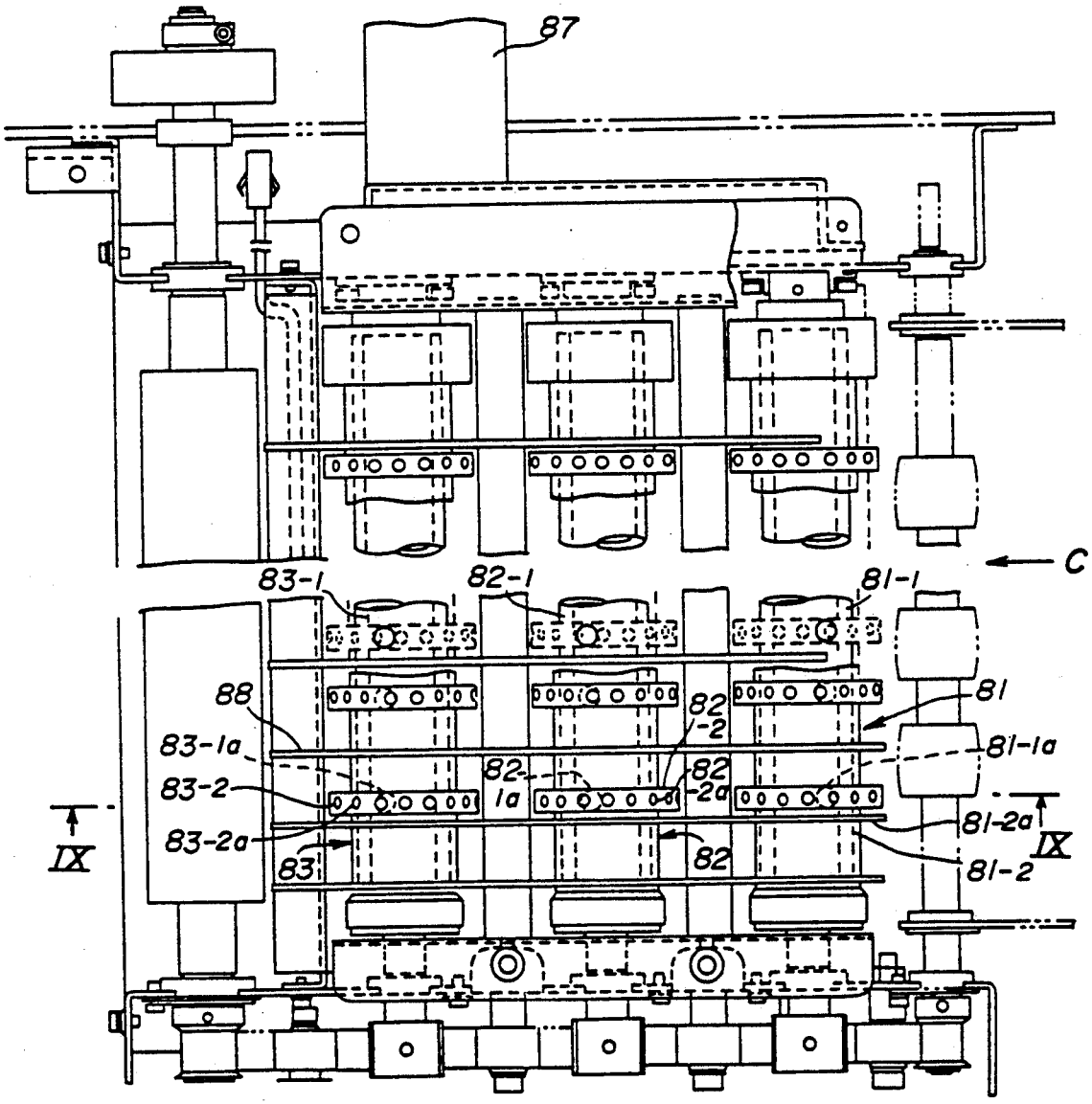
FIG. 10 is a partially cut away plan view of the sheet paper feed apparatus of FIGS. 9 and 9A.

In FIGS. 9 and 9A and FIG. 10, a first sheet paper feed apparatus 81, a second sheet paper feed apparatus 82, and a third sheet paper feed apparatus 83 are provided in line in the direction of sheet paper feed.

Each of the sheet paper feed apparatus 81, 82 and 83 has a structure so that rollers 81-2, 82-2 and 83-2 are rotatably engaged with hollow fixed center shafts 81-1, 82-1 and 83-1, respectively and each of the rollers 81-2, 82-2 and 83-2 are belt driven to rotate in the counterclockwise direction indicated by the arrow D.

Each of the rollers 81-2, 82-2 and 83-2 has formed around its entire periphery a plurality of holes 81-2*a*, 82-2*a* and 83-2*a*, respectively.

In each of the hollow fixed center shafts 81-1, 82-1 and 83-1 are formed openings 81-1*a*, 82-1*a* and 83-1*a*, respectively.

Opening 81-1*a* is formed so as to make a predetermined angle $\theta$ (of 10°) in the clockwise direction, with respect to the surface 84 which is perpendicular to sheet paper feed surface 22 and extends through the center 81-1*b* of the hollow fixed center shaft 81-1.

Openings 82-1*a* and 83-1*a* are formed so as to make a predetermined angle $\theta$ (of 10°) in the counterclockwise direction, with respect to surfaces 85 and 86 which are perpendicular to sheet paper feed surface 22 and extend through the centers 82-1*b* and 83-1*b* of the hollow fixed center shafts 82-1 and 83-1.

Each of the hollow fixed center shafts 81-1, 82-1 and 83-1 communicates with a negative pressure source (blower) 87.

The sheet paper 20 is successively adhered by each of the sheet paper feed apparatus 81, 82 and 83, and is supported and guided by the guide 88 and fed in the direction shown by the arrow C. The upper surface of the guide 88 serves as the sheet paper feed surface 22 already described.

The feed force applied to the sheet paper 20 by each of the sheet paper feed apparatus 81, 82 and 83 is as shown by the arrows F3, F4 and F5.

More specifically, the feed force F3 applied by the first sheet paper feed apparatus 81 which is at the entrance portion to the sheet paper feed apparatus 80 is in a direction which is inclined by the angle $\theta$ in the upwards direction with respect to the sheet feed surface 22.

The feed forces F4 and F5 which are applied by the second and third sheet paper feed apparatus 82 and 83 which are in the middle and exit portions of the sheet paper feed apparatus 80 and in which paper misfeeds of the sheet paper 20 are most likely to occur are in the direction which is inclined by the angle $\theta$ in the downwards direction with respect to the sheet feed surface 22.

Because of this, the sheet paper 20 is fed without rising from the sheet feed surface 22, and even in cases where the distal end of the sheet paper 20 is curled in the upwards direction, it can still be fed without catching on the step portion 24 of the downwards surface of the fixing unit 17.

The following is a description of the sheet paper feed apparatus 90 of a second embodiment according to the present invention, based on the principle shown in FIG. 7. The description is made with reference to FIGS. 11 and 11A.

Figures 11, 11A:
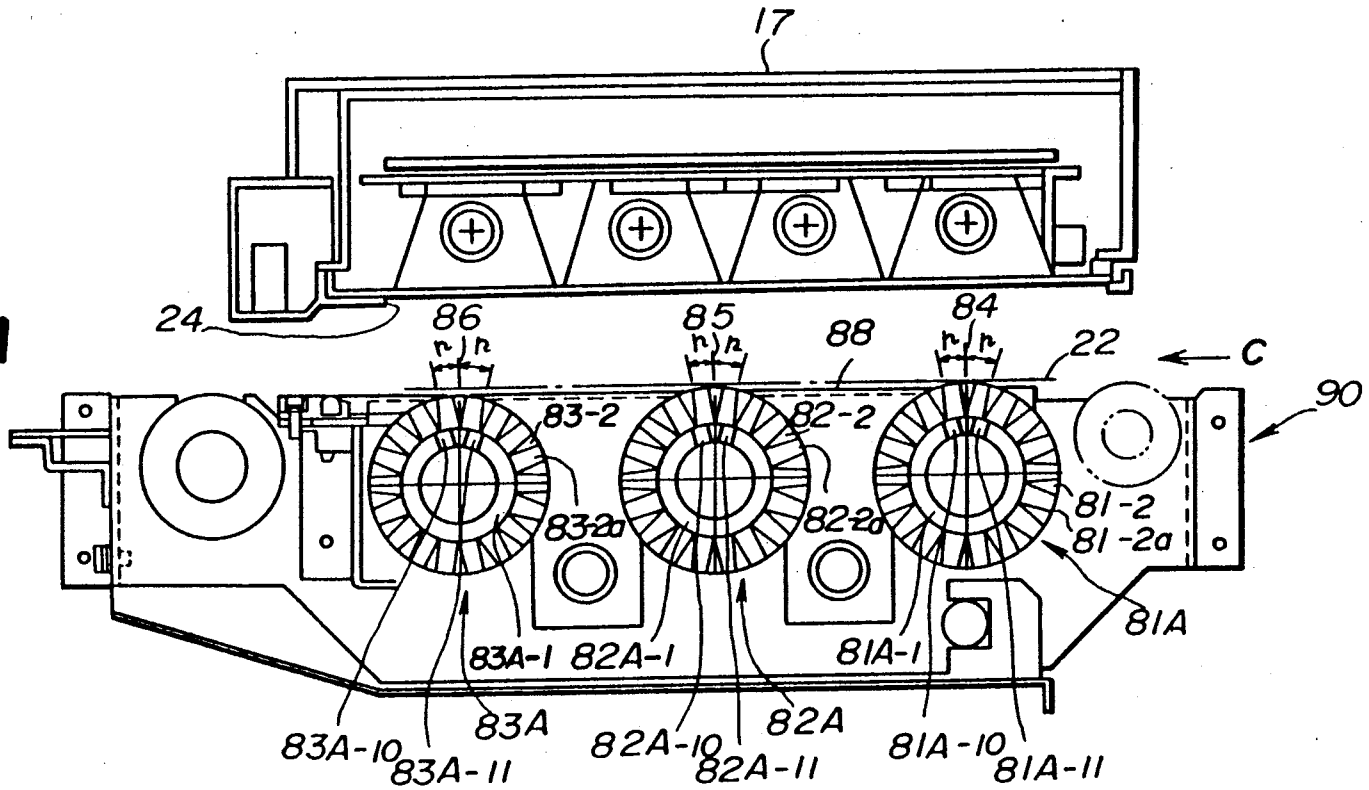
FIGS. 11 and 11A are a view showing a second embodiment of a sheet paper feed apparatus according to the present invention on the basis of the principle shown in FIG. 7.

In FIGS. 11 and 11A, portions corresponding to similar portions in FIGS. 9 and 9A indicated with the same numerals.

The first, second and third sheet paper feed apparatus 81A, 82A and 83A are configured so that hollow fixed center shafts 81A-1, 82A-1, 83A-1 are provided with two openings 81A-10 and 81A-11, 82A-10 and 82A-11, and 83A-10 and 83A-11 respectively, at positions that are at the angle $\gamma$ in both the clockwise direction and the counterclockwise direction with respect to the surfaces 84, 85 and 86.

Each of the sheet paper feed apparatus 81A, 82A and 83A firstly adhere the sheet paper, due to the openings 81A-11, 82A-11, and 83A-11 that are shifted in the clockwise direction, and apply a feed force in the direction inclined downwards with respect to the sheet feed surface 22, due to the openings 81A-10, 82A-10 and 83A-10 that are shifted in the counterclockwise direction.

In the present embodiment as well, the sheet paper is fed without rising from the sheet feed surface 22 and is fed without the likelihood of paper misfeed occurring.

The following is a description of a configuration of another principle of the sheet paper feed apparatus of the present invention, and the action thereof.

Figure 12:
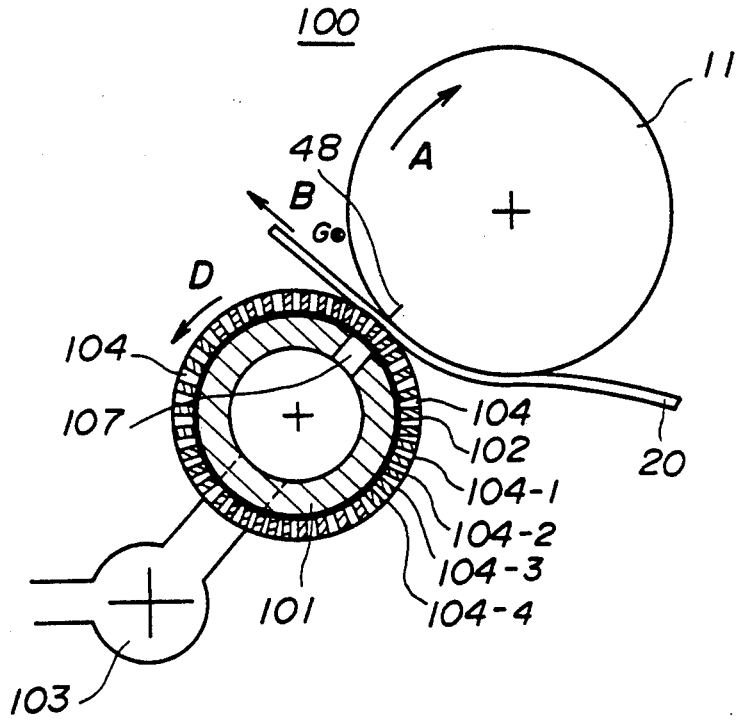
FIG. 12 is another view of a third embodiment showing the general principle of a sheet paper feed apparatus of the present invention.

FIG. 12 is another view of a configuration describing another general principle of a sheet paper feed apparatus 100 of the present invention.

A roller 102 is provided on a hollow member 101 so as to be rotatable.

A negative pressure source 103 is provided so as to communicate with the hollow member 101.

The roller 102 is formed with many holes 104 around its entire periphery.

The hollow member 101 is formed with a single opening 107 that opposes the paper peeling portion 48 on the peripheral surface of the photosensitive drum 11.

The holes 104 have their pitch and size determined along with the size of the opening 107 so that the opening 107 is always opposing two or three of the holes 104.

The photosensitive drum 11 rotates in the direction shown by the arrow A, and the roller 102 rotates in the direction shown by the arrow D.

When the roller 102 rotates, each of the holes 104 opposing the opening 107 produces a suction action and the sheet paper 20 is adhered to the peripheral surface of the roller 102 and is peeled from the photosensitive drum 11 and fed in the direction of the arrow B by the rotation of the roller 102.

The following is a description of the action of the holes 104-1 through 104-4 that are lined in the direction opposite to the direction of rotation of the roller 102.

Figure 13:
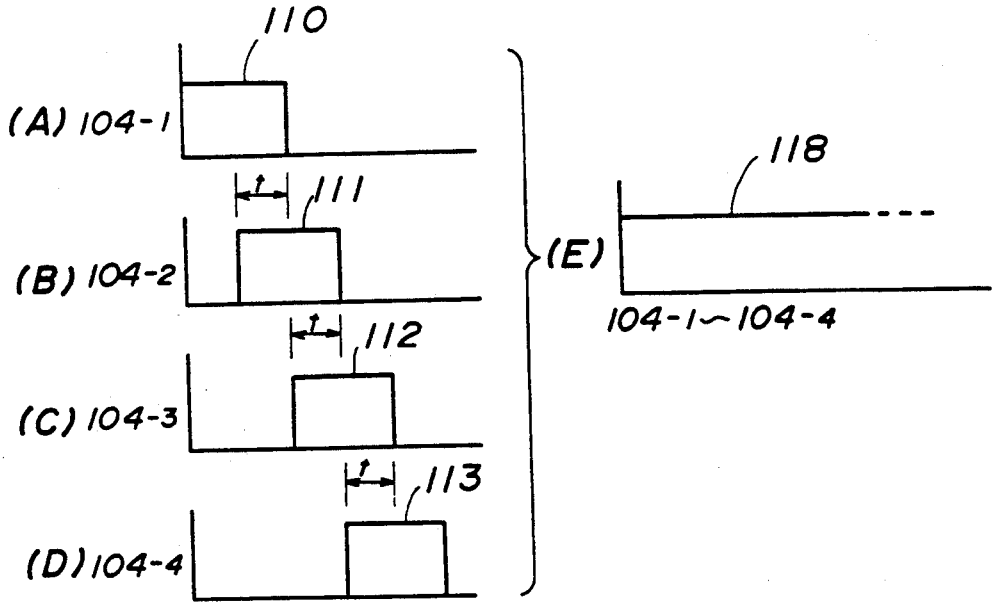
FIG. 13 is a chart showing the sheet paper suction action of the apparatus of FIG. 12.

The holes 104-1 through 104-4 perform a suction action as shown by lines 110 through 113 in FIG. 13 (A) through (D).

Figure 14:
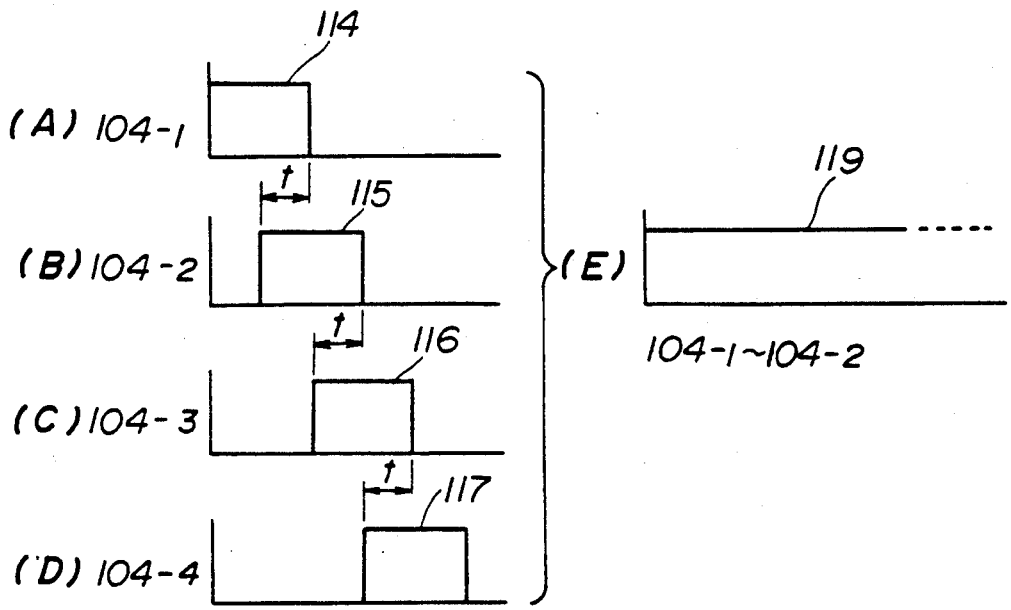
FIG. 14 is a chart showing the sheet paper feed action of the apparatus of FIG. 12.

In addition, the holes 104-1 through 104-4 perform feed action as shown by the lines 114 through 117 in FIG. 14 (A) through (D).

The time that suction action is performed by adjacent holes of the holes 104-1 through 104-4 partially overlaps. In FIGS. 13 and 14, the time t indicates the time that suction action overlaps.

Because of this, the suction force due to the holes 104-1 through 104-4 is continuously applied without interruption, as shown by the line 118 of FIG. 13 (E).

Also, the feed force due to the holes 104-1 through 104-4 is continuously applied without interruption, as shown by the line 119 in FIG. 14 (E).

Accordingly, the apparatus 100 applies a peeling force and a feed force to the paper peeling portion 48.

As a result, the peeling of the sheet paper 20 from the photosensitive drum 11 is performed much more reliably than in the case of a conventional embodiment, and the sheet paper 20 is fed in the direction of the arrow B more stably than conventionally.

The following is a description of a sheet paper feed apparatus 120 of one embodiment according to the present invention based on the principle described above, with reference to FIG. 15 through FIG. 19.

Figure 16:
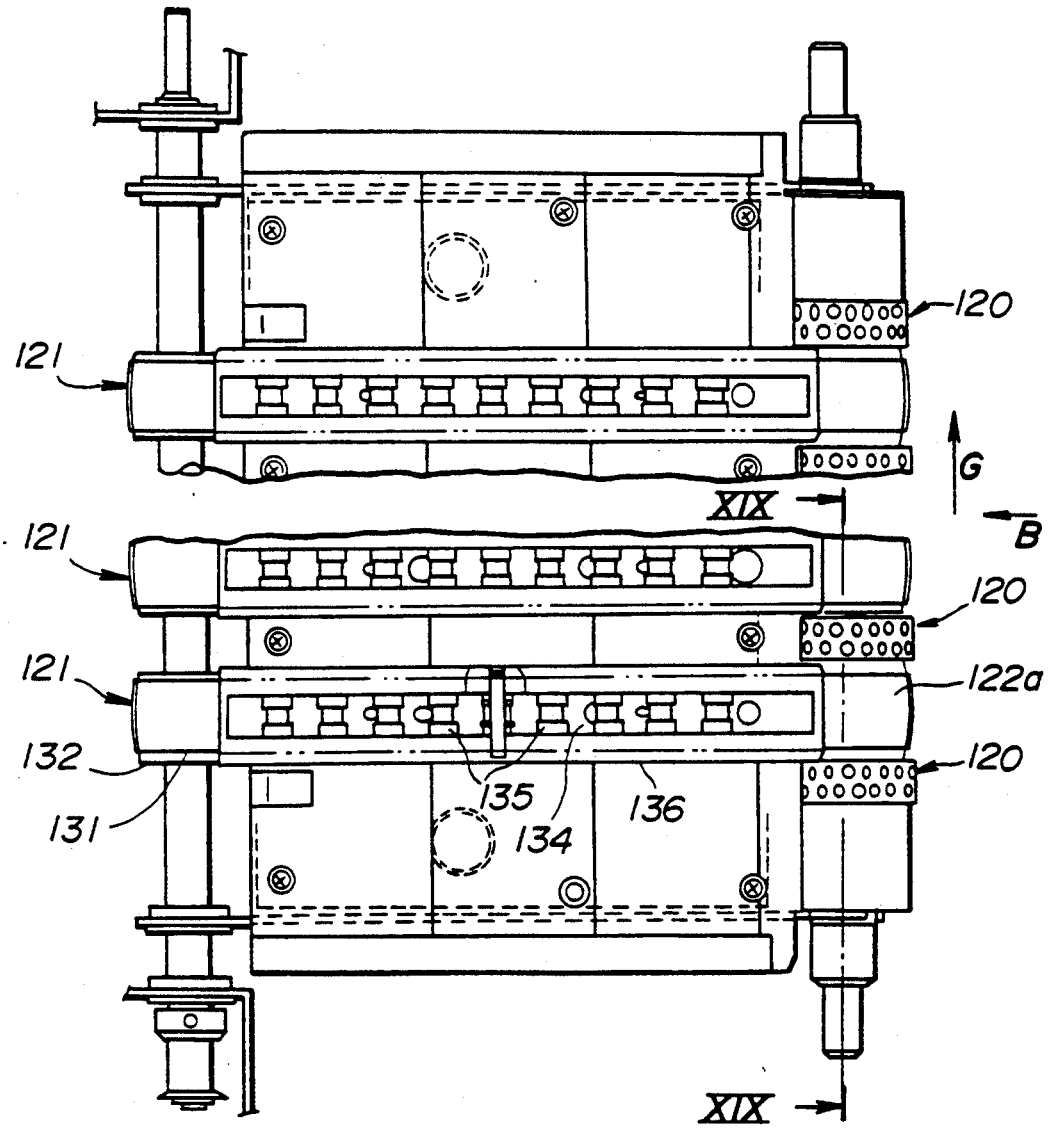
FIG. 16 is a plan view of the apparatus of FIG. 15.

As shown in FIG. 16, the sheet paper feed apparatus 120 are provided at intervals in the direction of the shaft of the photosensitive drum 11, that is, in the direction shown by the arrow G perpendicularly intersecting with respect to the direction of feed B of the sheet paper.

Sheet paper feed apparatus 121 of the belt type are provided between adjacent sheet paper feed apparatus 120.

Figure 17:
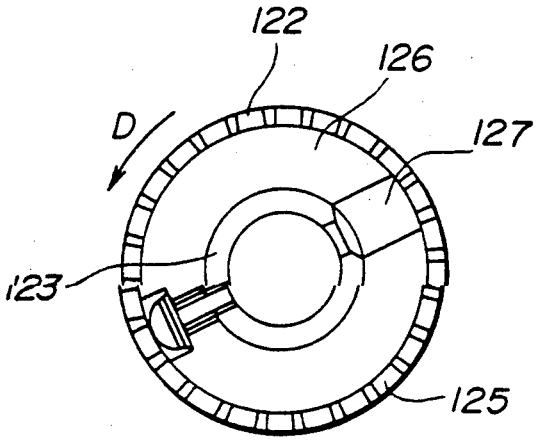
FIG. 17 is an enlarged view of the roller, hollow member and sleeve in FIG. 15.
Figure 18:
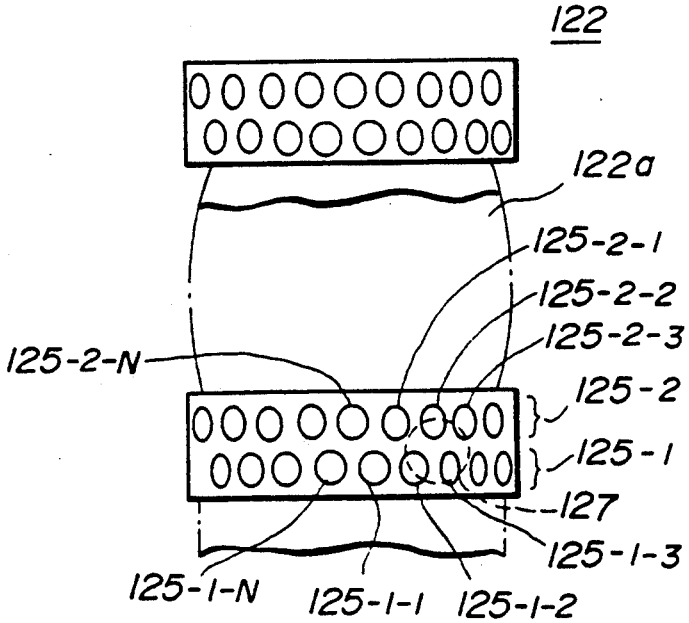
FIG. 18 is a view showing the relationship between the sleeve and the hole in the periphery of the roller in FIG. 16.
Figure 19:
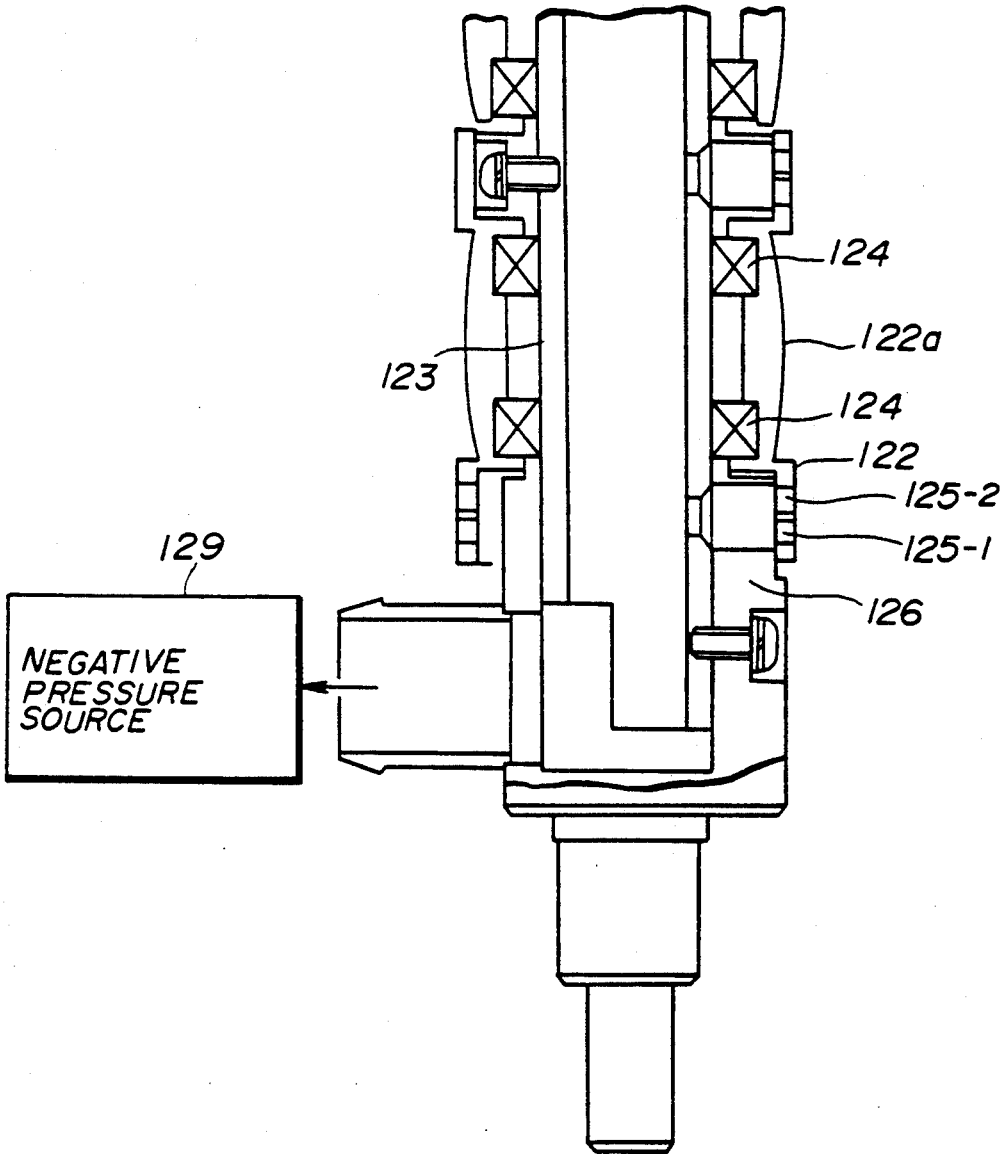
FIG. 19 is an enlarged sectional view taken along the section lines XIX—XIX of FIG. 16.

FIG. 17 through FIG. 19 are enlarged views of one portion of each of the sheet paper feed apparatus 120.

As shown in FIG. 19, a roller 122 is supported on a hollow member 123 by a bearing 124 so as to be rotatable.

The roller 122 has two rows of a plural number of holes in zigzag shape.

A first row hole group 125-1 comprises holes 125-1-1 through 125-1-N.

A second row hole group 125-2 comprises holes 125-2-1 through 125-2-N.

Holes 125-1-1 through 125-1-N and holes 125-2-1 through 125-2-N are arranged in zigzag shape.

When a predetermined hole is not to be specified, these holes are indicated by the number 125.

The hollow member 123 is in fixed engagement with a sleeve 126.

Figure 15:
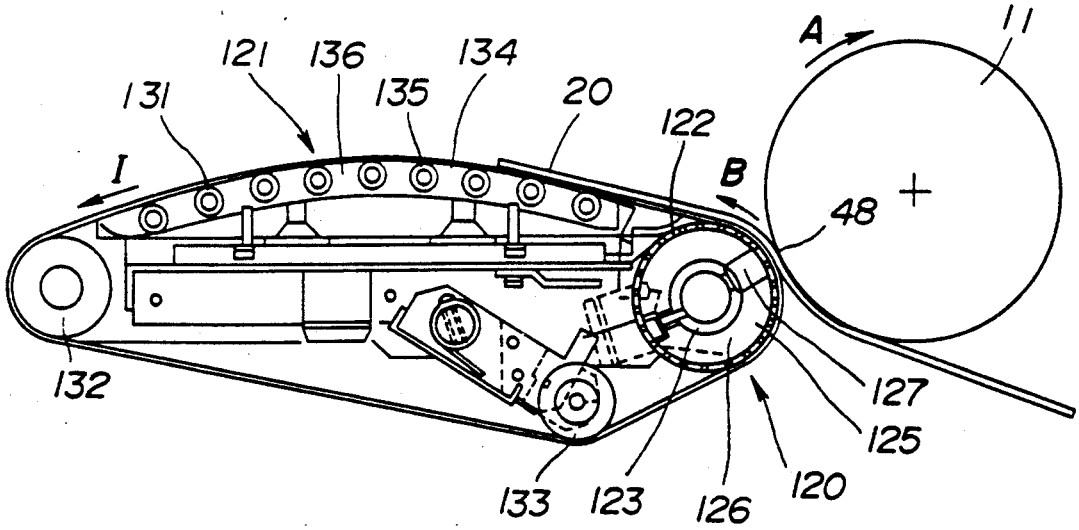
FIG. 15 is an elevational view showing a fourth embodiment of the present invention on the basis of the principle of FIG. 12.

A single opening 127 is formed in the hollow member 123 and sleeve 126 so as to oppose the paper peeling portion 48 on the peripheral surface of the photosensitive drum 11 (refer to FIG. 15).

The opening 127 has a size that spans the first row and the second row of holes described above.

The size of the opening 127 and the pitch of the holes 125 are determined so that the opening 127 always opposes three or four of the holes 125. In FIG. 18, the holes 125-1-2, 125-1-3, 125-2-2 and 125-2-3 oppose the opening 127.

The terminal side of the hollow member 123 communicates with the negative pressure source 129.

The roller 122 forms a unit with a pulley portion **122*a* around which a belt 131** is wound.

In FIG. 15, the photosensitive drum 11 is rotated in the direction indicated by the arrow A, and the roller 122 rotates by way of the belt 131 at the same speed as the photosensitive drum 11 and in the direction indicated by the arrow D.

In addition, the negative pressure source 129 also operates.

While the roller 122 is rotating, three or four of the holes 125 are always opposing the opening 127.

Because of this, the negative pressure source 129 always has a continuous suction force operating with respect to the sheet paper 20 and the rotation of the rollers 122 act to continuously feed the sheet paper 20.

Accordingly, even though the feed speed of the sheet paper 20 is relatively higher when compared to the conventional apparatus, the sheet paper 20 is reliably peeled and conveyed by the photosensitive drum 11.

In addition, the holes 125 are in two rows in a zigzag shape and so when compared to the case where there is only one row of holes, it is sufficient to have a small opening opposing the three holes. Because of this, this portion of the suction force acts concentratedly to the paper peeling position 48 and the sheet paper 20 is reliably peeled from the drum 11.

The apparatus 120 having the configuration described above is provided in plural at equidistant intervals in the direction of the shaft of the photosensitive drum 11 and the sheet paper 20 is sucked at these plural number of places across the width thereof and is peeled from the photosensitive drum 11 and fed reliably for across its entire width.

As shown in FIG. 15 and FIG. 16, the sheet paper feed apparatus 121 has a structure where a belt 131 having many holes is fitted around the pulley portion **122*a* and the rollers 132 and 133 (as shown by the double-dotted line in FIG. 16). An arc-shaped block 136 is provided, which is convex in the upwards direction and has a ventilation groove 134 on the upper surface thereof. Along the block 136, there is provided a plural number of guide rollers 135 to guide the belt 131**.

Furthermore, the ventilation groove 134 described above communicates with the negative pressure source 129.

The belt 131 runs in the direction of the arrow I at the same speed as the peripheral speed of the roller 122 and a suction force acts in the region running on the block 134.

Accordingly, the sheet 20 that has been peeled and conveyed by the apparatus 120 is quickly adhered to the belt 131 and is fed in the direction of the arrow I.

The suction force due to the negative pressure source 129 also acts on the belt 131. Even if the belt 131 is pressed, the belt 131 is actually guided by the guide roller 135 and runs with a comparatively light load.

As shown in FIG. 16, this sheet paper feed apparatus 121 is provided in a plural number, between adjacent apparatus 120, in the direction of the shaft of the photosensitive drum 11 and performs the smooth and reliable feed of the sheet paper 20 after it has been peeled from the photosensitive drum 11.

Further, the present invention is not limited to these embodiments, but other variations and modifications may be made without departing from the scope of the present invention.

What is claimed is:

1. A sheet paper feed apparatus, comprising:

(a) a roller that rotates in a direction of sheet paper feed and has a plurality of holes around its periphery, (b) a hollow fixed center shaft that supports said roller rotatably and has an opening on a side of a surface of sheet paper that is fed, and (c) a negative pressure source communicating with said hollow fixed center shaft, rotation of said roller causing said peripheral holes to successively communicate with said opening, thus creating a suction action to adhere and feed said sheet paper, wherein said hollow fixed center shaft has said opening at a position shifted by a predetermined angle in the direction of sheet feed with respect to a line that is perpendicular to said sheet paper feed surface and passes through a center of said hollow fixed center shaft;

wherein said plurality of holes of said roller is formed in two circumferential zigzag-shaped rows such that, relative to a longitudinal axis of the roller, a hole in one row is non-collinear relative to an adjacent hole in the other row, and wherein the two zigzag-shaped rows are arranged so that holes of both of the zigzag-shaped rows always communicated with the opening of the fixed shaft.

2. The sheet paper feed apparatus as claimed in claim 1, wherein:

said predetermined angle is approximately 10 degrees.

3. The sheet paper feed apparatus as claimed in claim 1, further comprising guides extending along said sheet paper feed surface and supporting and guiding sheet paper that is fed.

4. A sheet paper feed apparatus as claimed in claim 1, wherein:

a plurality of said sheet paper feed apparatus is provided in the direction of feed of the sheet paper.

5. A sheet paper feed apparatus, comprising:

(a) rollers that rotate in a direction of sheet paper feed and have a plurality of holes around their peripheries, (b) a respective hollow fixed center shaft for supporting each roller rotatably, each shaft having an opening on a side of a surface of sheet paper that is fed, and (c) a negative pressure source communicating with said hollow fixed center shafts, rotation of said rollers causing said peripheral holes to successively communicate with said respective openings, thus creating suction action to adhere and feed said sheet paper, wherein one of said hollow fixed center shafts has said opening at a position shifted by a first predetermined angle in the direction of sheet feed with respect to a line that is perpendicular to said sheet paper feed surface, and passes through a center of said hollow fixed center shaft, and another of said hollow fixed center shafts has said opening at a position shifted at a second predetermined angle opposite the direction of sheet paper feed with respect to said perpendicular line, wherein said plurality of holes of each roller is formed in two circumferential zigzag-shaped rows such that, relative to a longitudinal axis of the roller, a hole in one row is non-collinear relative to an adjacent hole in the other row, and wherein the two zigzag-shaped rows are arranged so that the holes of both of the zigzag shaped rows always communicate with the opening of the respective fixed shaft.

6. The sheet paper feed apparatus as claimed in claim 5, wherein:

said first and second predetermined angles are each approximately 10 degrees.

7. The sheet paper feed apparatus as claimed in claim 5, further comprising guides extending along said sheet paper feed surface and supporting and guiding sheet paper that is fed.

8. A sheet paper feed apparatus as claimed in claim 5, wherein:

a plurality of said sheet paper feed apparatus is provided in the direction of feed of the sheet paper.

9. A sheet paper feed apparatus, comprising:

(a) a roller that rotates in a direction of sheet paper feed and has a plurality of holes around its periphery, (b) a hollow fixed center shaft that supports said roller rotatably and has an opening on a side of a surface of sheet paper that is fed, and (c) a negative pressure source communicating with said hollow fixed center shaft, rotation of said roller causing said peripheral holes to successively communicate with said opening, thus creating a suction action to adhere and feed said sheet paper, wherein said roller is formed so that at least one hole of said plurality of holes always closely opposes said opening of said hollow fixed center shaft while said roller is rotating, wherein said plurality of holes of said roller is formed in two circumferential zigzag-shaped rows such that, relative to a longitudinal axis of the roller, a hole in one row is non-collinear relative to an adjacent hole in the other row, and wherein the two zigzag-shaped rows are arranged so that holes of both of the zigzag-shaped rows always communicate with the opening of the fixed shaft.

* * * * *

UNITED STATES PATENT AND TRADEMARK OFFICE

CERTIFICATE OF CORRECTION

PATENT NO. : 5,186,451

DATED : February 16, 1993

INVENTOR(S) : NAOTO HIRAO

It is certified that error appears in the above-identified patent and that said Letters Patent is hereby corrected as shown below:

Title page, under "FOREIGN PATENT DOCUMENTS", insert the following:

| | | |
|---|---|---|
| 1011438 | 7/1957 | Germany |
| 912812 | 8/1946 | France |
| 2760141 | 12/1977 | Germany |
| 2433545 | 10/1988 | Germany |
| 313088 | 4/1989 | Europe; |

Col. 1, line 61, delete "number";

Col. 3, line 51, "view for describing" should be --chart showing--;

UNITED STATES PATENT AND TRADEMARK OFFICE

CERTIFICATE OF CORRECTION

PATENT NO. : 5,186451

DATED : February 16, 1993

INVENTOR(S) : Naoto Hirao

It is certified that error appears in the above-indentified patent and that said Letters Patent is hereby corrected as shown below:

Column 3, line 60, after "of", insert --a--

Column 6, line 2, after "9A", insert --are--

Signed and Sealed this

Seventh Day of December, 1993

*Attest:*

Bruce Lehman

BRUCE LEHMAN

*Attesting Officer*

*Commissioner of Patents and Trademarks*